United States Patent [19]

Zanini

[11] 4,455,709

[45] Jun. 26, 1984

[54] FLOOR MOUNTED GUIDE AND SHIM ASSEMBLY FOR SLIDING DOORS

[76] Inventor: Walter D. Zanini, 1421 Myrtle, Turlock, Calif. 95380

[21] Appl. No.: 389,365

[22] Filed: Jun. 16, 1982

[51] Int. Cl.[3] ..... E05D 13/02

[52] U.S. Cl. ..... 16/90; 49/411

[58] Field of Search ..... 16/87.4 R, 90, 94 R, 16/95 R, 96 R; 49/409, 410, 411

[56] References Cited

U.S. PATENT DOCUMENTS

| | | | |
|---|---|---|---|
| 2,939,167 | 6/1960 | Preston | 16/90 |
| 3,118,169 | 1/1964 | Foltz | 16/90 |
| 3,132,371 | 5/1964 | Enos et al. | 49/411 X |
| 3,298,056 | 1/1967 | Hentzl | 16/90 |
| 3,345,677 | 10/1967 | Milette | 16/90 |
| 3,942,197 | 3/1976 | Sudmann | 16/90 X |
| 4,258,443 | 3/1981 | Baus | 16/90 X |

FOREIGN PATENT DOCUMENTS

| | | | |
|---|---|---|---|
| 2428049 | 1/1976 | Fed. Rep. of Germany | 16/96 R |

*Primary Examiner*—Fred Andrew Silverberg
*Attorney, Agent, or Firm*—Harvey B. Jacobson

[57] ABSTRACT

A guide assembly for sliding doors oriented over a carpeted area and including a guide member and a shim or shims in which the guide member has spaced, upstanding and integral side walls and a center partition forming channels for guiding overlapping sliding doors and the shim is the same shape as the guide and constructed of various thicknesses for positioning under the guide so that a solid base is provided for the guide and for raising the guide to the level of the carpet.

7 Claims, 6 Drawing Figures

FLOOR MOUNTED GUIDE AND SHIM ASSEMBLY FOR SLIDING DOORS

BACKGROUND OF THE INVENTION

1. Field of the Invention

The present invention relates to guide assemblies for doors, including a guide member and shim supporting the guide member, the assembly adapted for receiving rolling closet or cabinet doors, and the shim being made of any selected thickness such as ⅛", ¼", ⅜" and ½" in thickness so that a variety of shimming heights can be obtained. More particularly, the invention relates to a guide assembly of guides and shims for doors passing therethrough and in which the guide and a shim or shims are secured stably to a deck or floor surface by screw fasteners, and in which there is provided a convenient structure to provide for a solid base on the floor and for raising the guide to a height level with the top of the padding and carpeting materials.

2. Description of the Prior Art

The following U.S. patents relate to door guides: U.S. Pat. Nos. 2,750,622—June 19, 1956—Stark, 2,898,623—Aug. 11, 1959—Johnson, 3,118,169—Jan. 21, 1964—Foltz, 3,205,529—Sept. 14, 1965—Vintan, 3,454,979—July 15, 1969—Harbertson, 3,493,990—Feb. 10, 1970—Winn.

The patents to Vintan and Winn disclose guides for sliding doors supported on support legs extending through holes punched through the carpet and pad with the length of the legs being varied in length so that the guide will be positioned just above the carpet. The patent to Harbertson discloses a guide unit for sliding doors placed over the carpet, and the other patents are of more general interest. None of these patents discloses all of the specific details of the present invention in such a way as to bear upon the patentability of any claims of the present invention.

SUMMARY OF THE INVENTION

An object of the present invention is to provide a guide and shim assembly for engagement with rolling closet or cabinet doors and in which a guide is mounted on the shim body which is of the same shape, construction and material as the guide so that the guide is raised to the level proximate the top of the carpeting in order that the padding and carpet can simply be cut forming a recess for the shim, then installed by fitting the carpet around the shims or risers, and then installing the guide thereon for engagement with the sliding doors.

Another object of the present invention is to provide plastic guide assemblies for doors in which the guides are mounted on separate shim structures and being of the same general shape as the guide so that the guide is raised to a level proximate the top of the carpet, and then the carpet is cut and fitted around the guide and shim assembly.

A further object of the present invention is to provide a convenient and readily constructed device in the form of a shim for raising a door guide to a height so as to provide a solid base on the deck or floor, and the raised guide is then on a level comparable with the top of the padding and carpeting.

Yet a further object of the present invention is to provide a plastic guide assembly including a shim which is contructed of various thicknesses such as ⅛", ¼", ⅜" and ½" so that any of a variety of shimming heights can be obtained for optimizing the use of a plastic guide assembly for sliding doors with any of a selection of characteristics of padding and carpeting.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
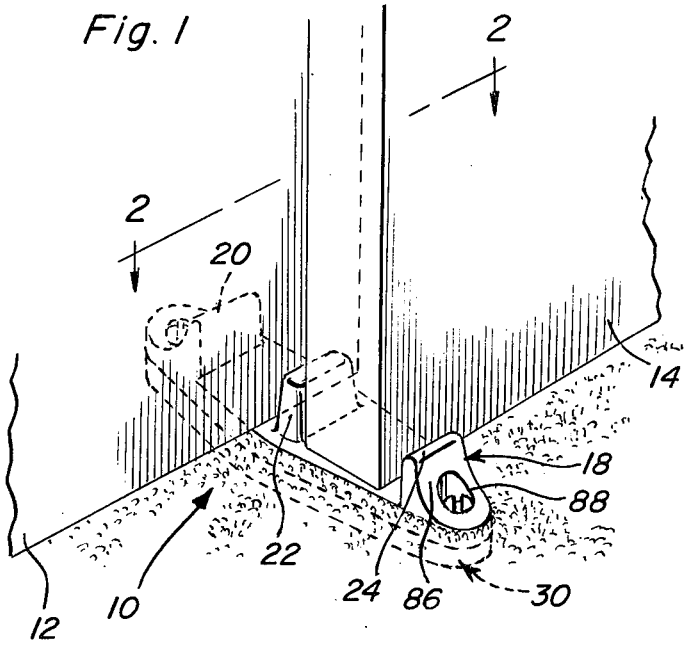
FIG. 1 is a perspective view of a guide assembly for doors according to the present invention.
Figure 2:
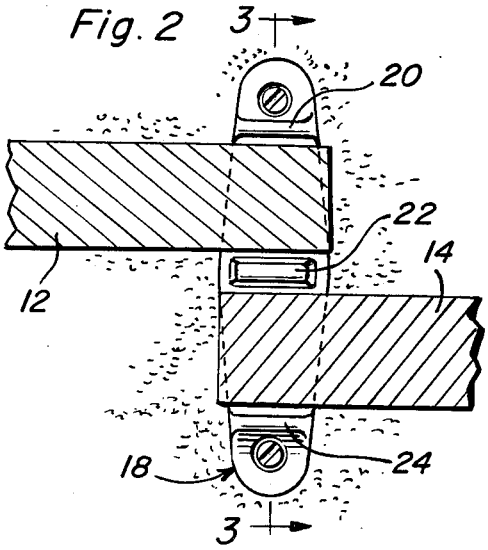
FIG. 2 is a top plan view taken along the line 2—2 of FIG. 1.
Figure 3:
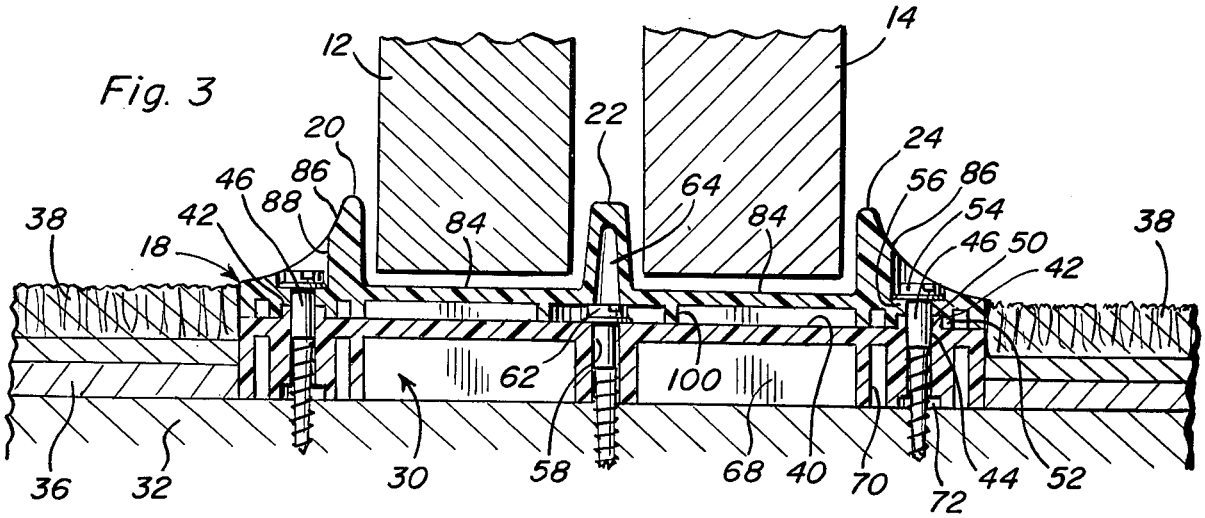
FIG. 3 is a sectional view taken along the line 3—3 of FIG. 2.
Figure 4:
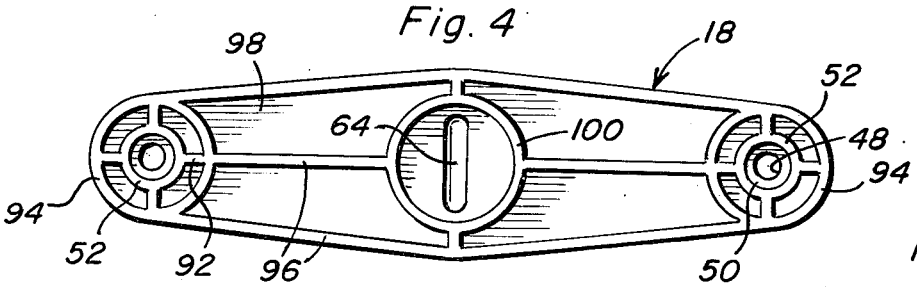
FIG. 4 is a bottom plan view of a door guide of the assembly.

Referring now to the drawings, there is shown a plastic guide and shim assembly 10 for doors 12, 14 such as rolling closet or cabinet doors and suspended by conventional hanging or sliding structures (not shown). The assembly 10 includes a plastic guide 18 having three upstanding guide rails or walls 20, 22, 24 which are spaced to receive doors of standard thickness. The guide 18 is mounted on a riser or shim 30 having a peripheral or exterior and horizontal configuration that is identically and symmetrically congruent with that of the guide 18, the shim 30 being supported directly from its undersurface from a deck, surface or floor 32. The vertical dimensions or thicknesses of the shim 30 may be of any selected thicknesses such as ⅛", ¼", ⅜" and ½", so that any of a variety of shimming heights can be obtained depending on the selection of a given and predetermined shim or plurality of shims 30. Floor padding 36 and carpet 38 having the usual backing are assembled and the padding and carpet 36, 38 are simply cut out to provide an opening or aperture configured to fit around the lateral periphery of the assembled guide 18 and the shim 30.

The shim 30 has a top surface 40 generally flat throughout, except for a generally circular and raised projection 42 through which there is a cylindrical hole or aperture 44 at each end portion of the shim for receiving a fastener or pan head screw 46. The top surface 40 of the shim 30 also contains a central and cylindrical aperture 58 to pass another pan head screw 60 that engages also with the floor 32. The pan head screw 60 has its undersurface of the head 62 in engagement with the top surface 40 of shim 30.

Figure 5:
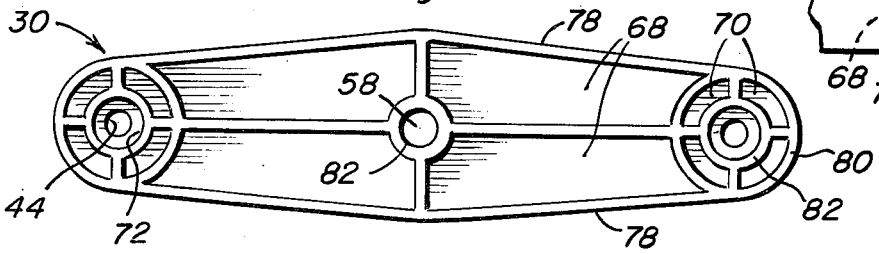
FIG. 5 is a bottom plan view of a shim of the assembly.
Figure 6:
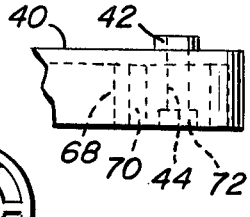
FIG. 6 is a fragmental side elevational view of a shim.

The underside of the shim 30 is provided, as shown in FIG. 5, with recessed portions 68, 70 and 72, the configuration and size of recessed portion 72 are defined as the same size and shape as projection 42 so that in case two shims 30 are in a stacked array, the projections 42 on the underlying shim will be received in recessed portions 72. The recessed portions 68, 70, 72 are defined by the ridges 78, 80, 82 which reinforce the shim 30. The exterior and peripheral surface on the lateral sides of the shim 30 are generally smooth throughout and engage with the cut portion of the padding 36 and carpet 38 as shown.

The guide 18 has an upper surface 84 shown generally flat between the guide rails or walls 20, 22, 24, and the end portions of the guide 18 are rounded and have generally concave upper surfaces 86 with the guide 18 having the same peripheral configuration as the shim 30. Each end portion of the guide 18 includes an aperture 48 receiving screw 46 and a counterbore 88 at the upper end of the aperture 48 to receive the pan head 54 of screw 48 as well as a cylindrical projecting lip 52 defining a recess 50 which telescopically receives projection 42 on shim 30 to retain the shim 30 and guide 18 in vertical alignment when stacked.

About each lip 52 on the undersurface of the guide 18 are supporting or strengthening webs or ridges 92, circular end ridges 94 and connecting webs or ridges 96 of the guide 18 defining recesses 98 that provide lightweight and strength to the entire structure of the guide 18. A ridge 100 on the undersurface of the guide encompasses a hollow elongated space 64 and is adapted to receive the pan head 62 of the screw 60 which extends only through the shim 30.

The guide 18 and the shim 30 are formed of molded material such as plastic, and similar materials, and the shim is constructed in various selected heights as risers or shims for the guide 18. Shims may have a thickness of $\frac{1}{8}''$, $\frac{1}{4}''$, $\frac{3}{8}''$ and $\frac{1}{2}''$ in thickness and padding and the carpet 36, 38 are cut to fit and fully engage the peripheral surfaces of the shims 30 and the guide 18.

Thus there is provided an improved plastic guide for top supported rolling closet or cabinet doors that have lower extremities that fit between the guide rails 20, 22, 24 with relative ease, and the guide 18 is fitted onto the shim 30 in a mating relationship as described in the above description so that there is provided a very convenient way of raising the guide height so as to provide a solid base on the deck or floor, thus elevating or raising the guide 18 to a level comparable with the top surface level of the padding and carpet 36, 38.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A guide and shim assembly for roller mounted or sliding doors comprising a one piece unitary guide provided with a set of upwardly extending walls to define a channel for guiding and passing a door therethrough, a shim of a predetermined and selected vertical thickness positioned under the guide, means aligning the guide and shim when stacked, the aligning means comprising projections on an upper surface of the shim and complementary receiving recesses in an undersurface of the guide and means securing the guide and shim to a supporting floor so that the channel can be positioned level with a surrounding carpeted area, the securing means comprising a central opening in the shim for a securing screw which is covered by the guide and aligned outer openings in both the shim and guide for further securing screws extending through the guide and shim.

2. The invention according to claim 1 wherein said guide includes three upstanding walls to form two channels to guide overlapping sliding doors.

3. The invention according to claim 1 wherein the outer openings in the shim and guide are formed through the respective projections and recesses.

4. The invention according to claim 1 wherein the central opening in the shim is flush with the upper surface of the shim and the guide has an aligned screw head-receiving recess in the undersurface.

5. The invention according to claim 1 wherein the guide and shim are constructed of plastic material throughout.

6. The invention according to claim 1 wherein the guide is adaptable for use with any of several shims of a desired dimension including $\frac{1}{8}''$, $\frac{1}{4}''$, $\frac{3}{8}''$, and $\frac{1}{2}''$ in thickness.

7. the invention of claim 3, wherein the projections and recesses comprise cylindrical elements.

* * * * *